US009259068B2

(12) United States Patent
Yu et al.

(10) Patent No.: US 9,259,068 B2
(45) Date of Patent: Feb. 16, 2016

(54) HOLDER FOR PORTABLE ELECTRONIC DEVICE

(71) Applicant: Chiun Mai Communication Systems, Inc., New Taipei (TW)

(72) Inventors: Tzu-Cheng Yu, Santa Clara, CA (US); Yin-Li Chang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 103 days.

(21) Appl. No.: 14/014,402

(22) Filed: Aug. 30, 2013

(65) Prior Publication Data

US 2014/0166505 A1 Jun. 19, 2014

(51) Int. Cl.
*B65D 5/52* (2006.01)
*A45C 11/00* (2006.01)

(52) U.S. Cl.
CPC ..... *A45C 11/00* (2013.01); *A45C 2011/002* (2013.01); *A45C 2200/15* (2013.01)

(58) Field of Classification Search
USPC ..... 206/45.2, 45.23, 45.24, 320
See application file for complete search history.

(56) References Cited

U.S. PATENT DOCUMENTS

| | | | | |
|---|---|---|---|---|
| 4,651,872 | A * | 3/1987 | Joyce | 206/760 |
| 5,996,778 | A * | 12/1999 | Shih | 206/45.2 |
| 8,253,518 | B2 * | 8/2012 | Lauder et al. | 335/219 |
| 8,393,464 | B2 * | 3/2013 | Yang et al. | 206/45.2 |
| 8,746,446 | B2 * | 6/2014 | Chiang | 206/320 |
| 8,915,357 | B2 * | 12/2014 | Mecchella | 206/45.23 |
| 2012/0325689 | A1 * | 12/2012 | Wibby et al. | 206/45.2 |

* cited by examiner

*Primary Examiner* — Jacob K Ackun
(74) *Attorney, Agent, or Firm* — Novak Druce Connolly Bove + Quigg LLP

(57) ABSTRACT

A foldable holder is used for holding and supporting a portable electronic device. The foldable holder includes a first section, a bending section, and a second section. The second section is connected to the first section by the bending section. The second section includes a main portion, two first support portions, a second support portion, and two third support portions. The second support portion is positioned between the two third support portions. When the foldable holder is folded, the third support portions are folded relative to the main portion, the first support portions, and the second support portion, to support the portable electronic device at an angle relative to the first section.

10 Claims, 10 Drawing Sheets

HOLDER FOR PORTABLE ELECTRONIC DEVICE

BACKGROUND

Technical Field

This disclosure relates to protective cases for portable electronic devices, and particularly to a holder for protecting and supporting a portable electronic device.

Cases are widely applied to protect portable electronic devices. When a user wants to watch the display of the portably electronic device at an angle, a holder for supporting the portable electronic device is needed. However, it can inconvenient to carry both the case and the holder.

Therefore, there is room for improvement within the art.

BRIEF DESCRIPTION OF THE DRAWINGS

Many aspects of the holder can be better understood with reference to the following drawings. The components in the drawings are not necessarily drawn to scale, the emphasis instead being placed upon clearly illustrating the principles of the holder.

DETAILED DESCRIPTION

Figure 1:
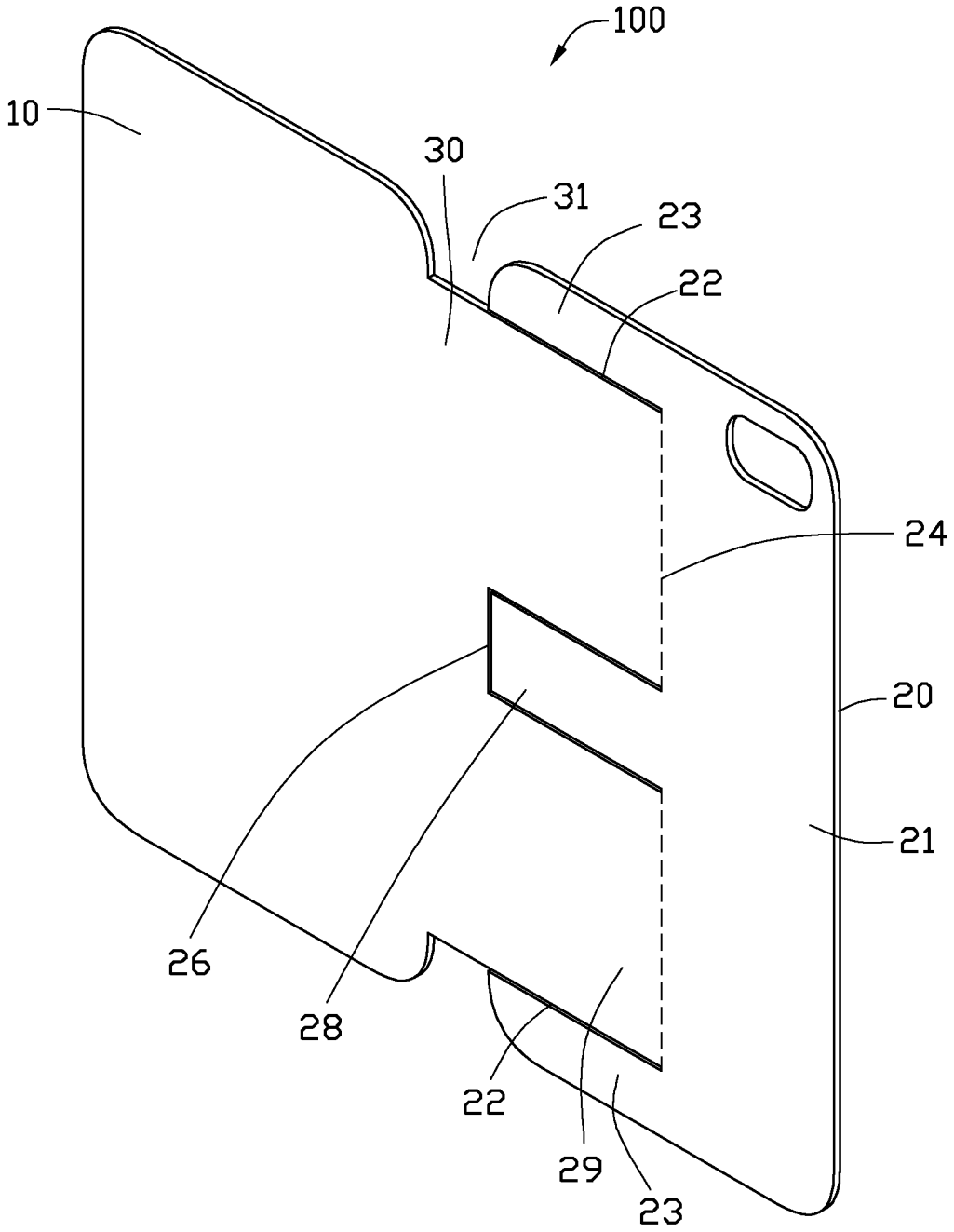
FIG. 1 is a schematic view of a holder in an unfolded state, according to a first exemplary embodiment.
Figure 2:
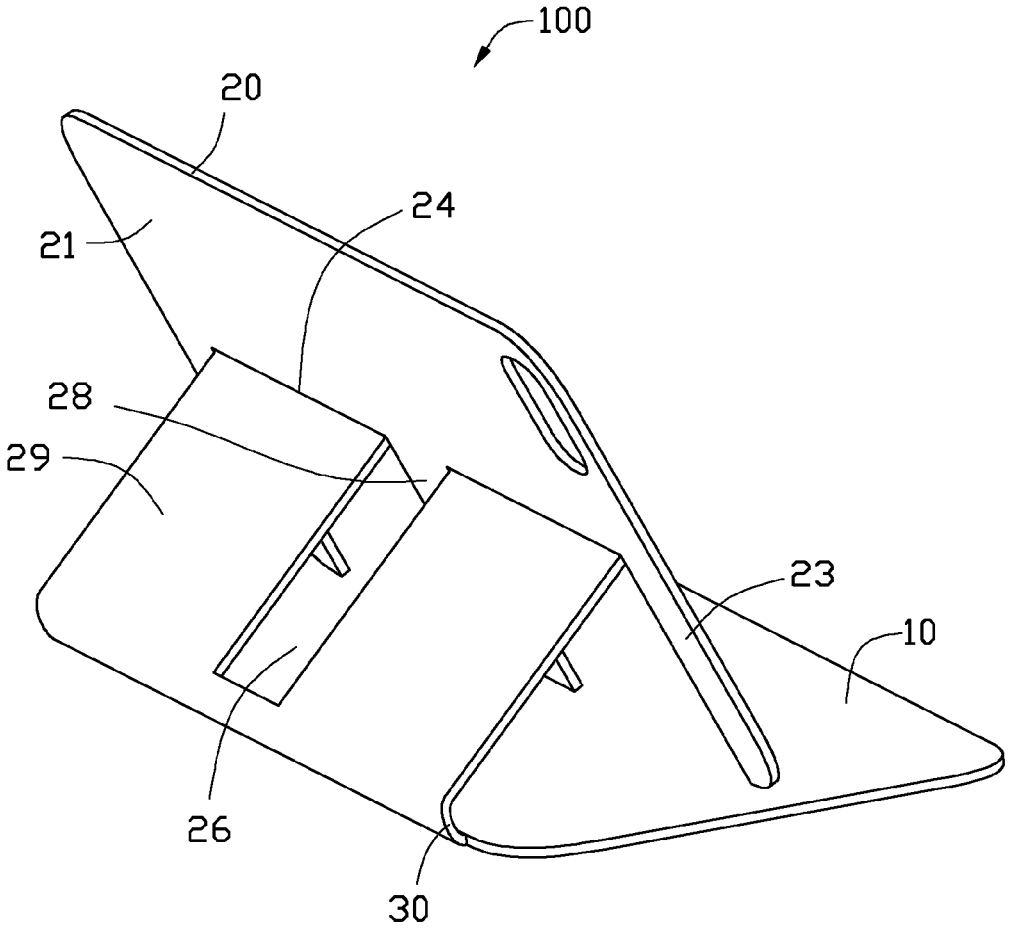
FIG. 2 is a schematic view of the holder shown in FIG. 1 in a folded state.

FIGS. 1 and 2 show a holder 100 in two different states. The holder 100 is configured for receiving and supporting a portable electronic device 200 (shown in FIG. 4), such as mobile phone.

The holder 100 is made of leather (natural or artificial), however, any other soft material, e.g., fiber, cotton, may also be used. The soft material needs a rigid ability for holding themselves in a support state. The holder 100 is a singular sheet subdivided into folding/bending portions that permit the sheet to fold or bend into a three-dimensional support structure. The holder 100 has a bending section 30. The sheet folds along the bending section 30, such that the unitary blank sheet is divided into a first section 10 and a second section 20. The first section 10 has a size substantially the same as a size of the second section 20, however, the first section 10 may also has a different size from the second section 20. The bending section 30 is positioned between the first section 10 and the second section 20. A length of the bending section 30 is shorter than a length of the first section 10 and the second section 20, thereby defining a notch 31. A width of the bending section 30 is substantially the same as a thickness of the portable electronic device 200, to allow the first section 10 and the second section 20 to respectively cover opposite surfaces of the portable electronic device 200.

Figure 4:
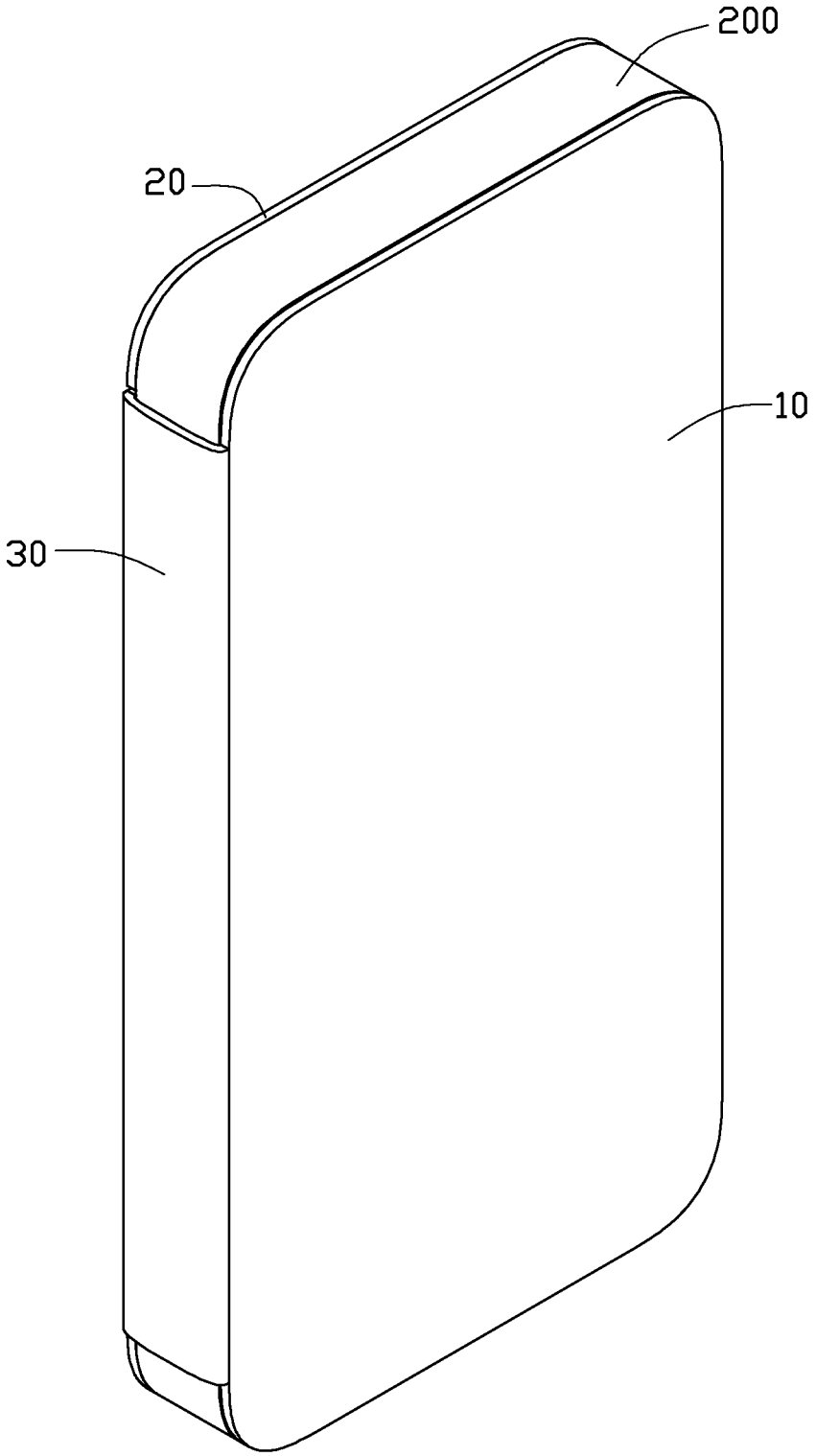
FIGS. 4 and 5 show different aspects of the holder folded to receive a portable electronic device.
Figure 5:
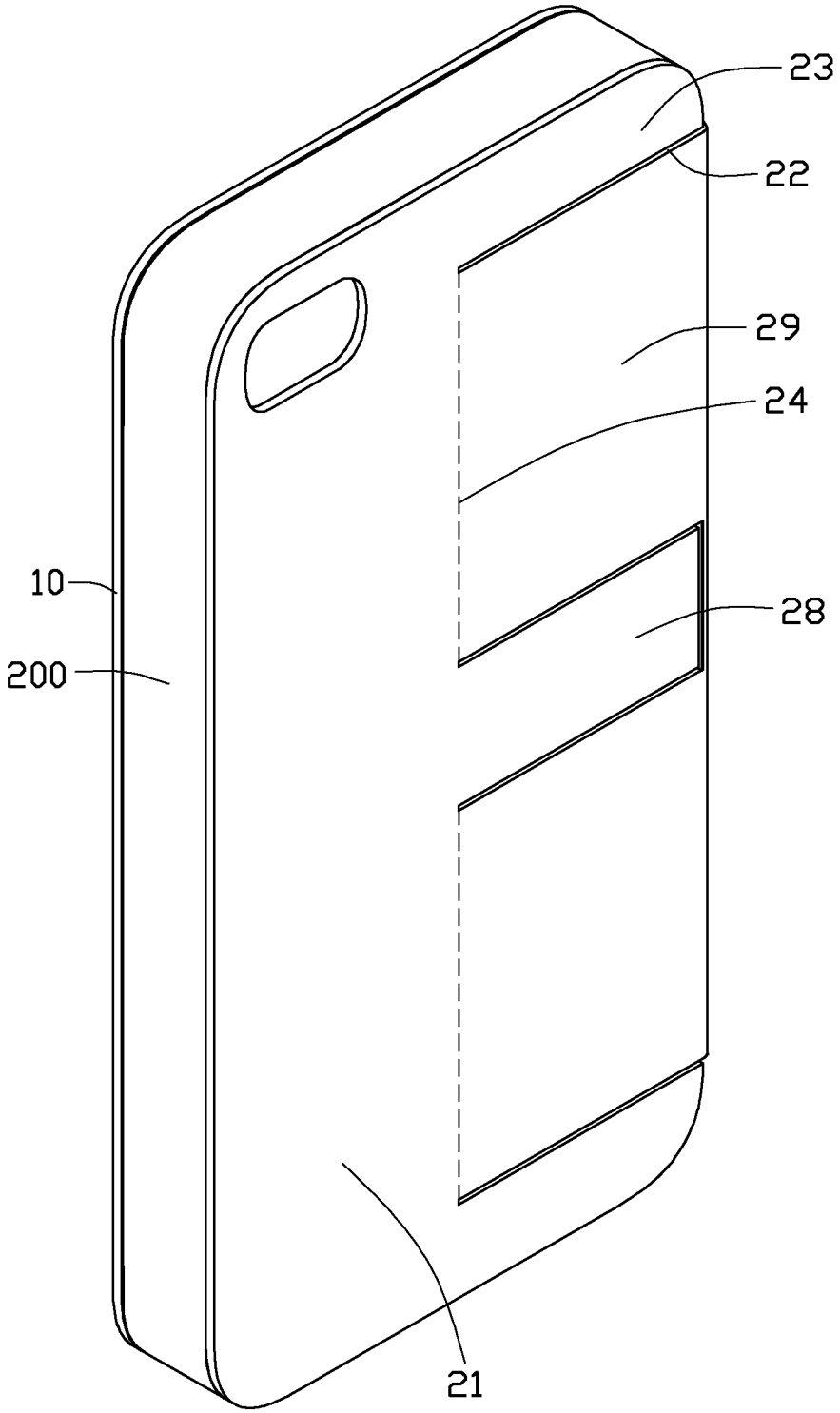
Figure 6:
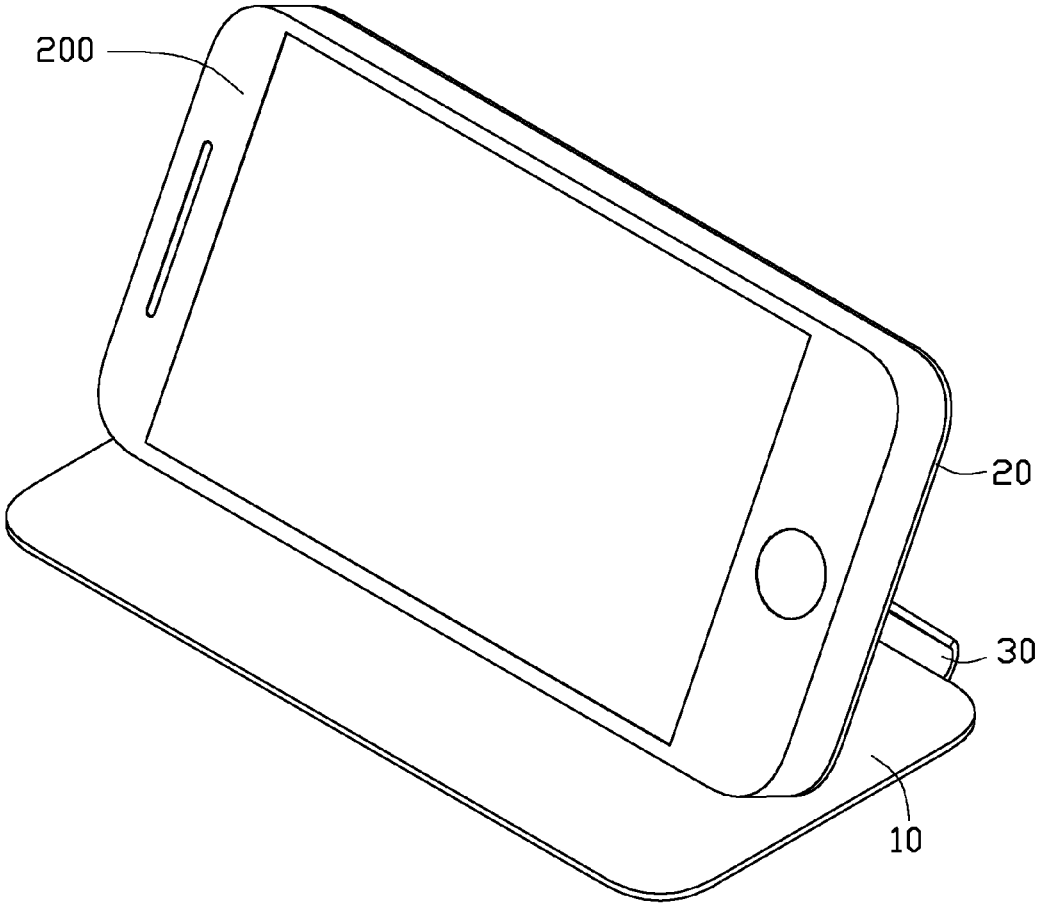
FIGS. 6 and 7 show different aspects of the holder in a position for supporting the portable electronic device for viewing.
Figure 7:
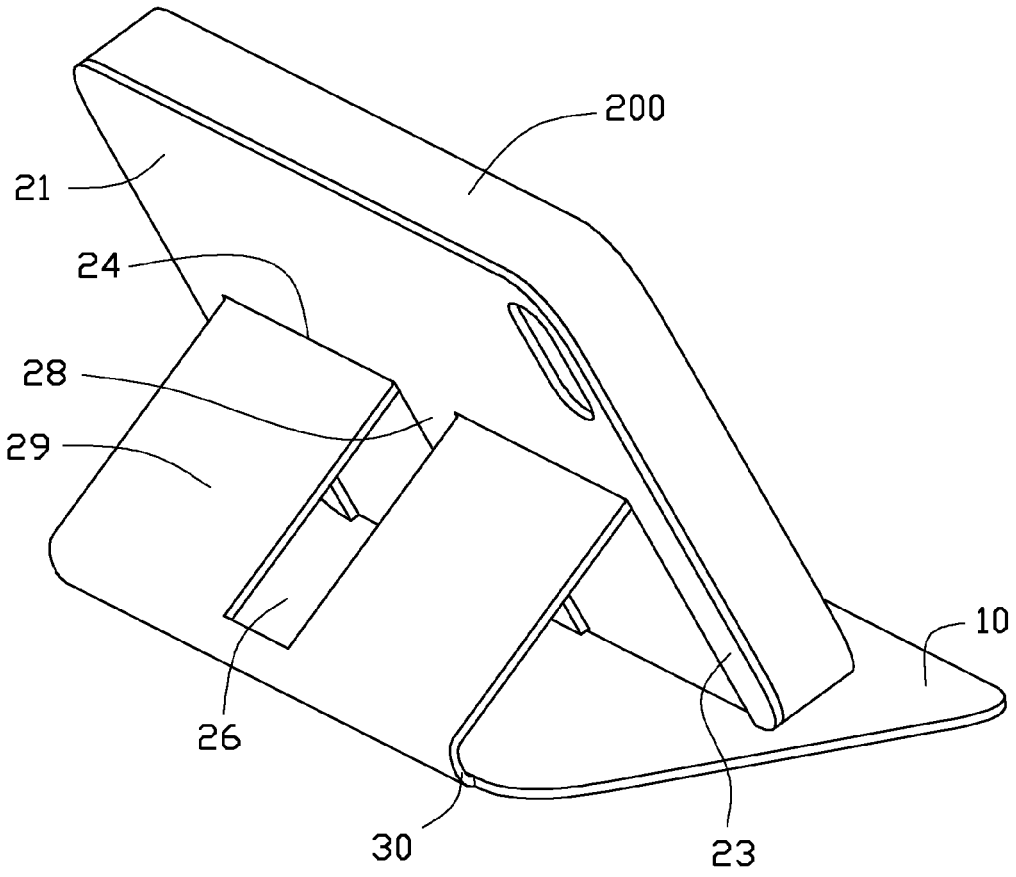

Referring to FIGS. 4 and 5, the first section 10 is for covering a front surface of the portable electronic device 200. The front surface has a display. The second section 20 is for covering a rear surface of the portable electronic device 200 and includes folded portions and mounted portions. Referring to FIGS. 6 and 7, when the holder is unfolded, the folded portions and the mounted portion are coplanar with each other. When the holder is folded, the folded portions of the second section 20 are folded relative to the mounted portions to hold the portable electronic device 200 in at an angle.

In this exemplary embodiment, the mounted portions include a main portion 21, two first support portions 23, and a second support portion 28. The folded portions include two third support portions 29. The main portion 21 is substantially rectangular, and the two first support portions 23, the second support portion 28, and the two third support portions 29 are connected to one side of the main portion 21. The second section 20 defines two first slits 22 and a second slit 26. The two first slits 22 are positioned at opposite ends of the second section 20. Each first slit 22 is aligned with one edge of the bending section 30 and separates the first support portion 23 from a corresponding third support portion 29. The second slit 26 is substantially U-shaped, and is defined in a middle of a side of the second section 20 to separate the second support portion 28 from the third support portions 29. A folding line 24 is formed between each third support portion 29 and the main portion 21. The main portion 21, the first support portions 23, and the second support portion 28 are fixed to the rear surface of the portable electronic device 200. The third support portions 29 are not fixed to the rear surface of the portable electronic device 200. When the third support portions 29 are folded along the folding lines 24, the second support portion 28 moves out of the second slit 26, and the third support portions 29 form an oblique angle with the main portion 21.

Figure 8:
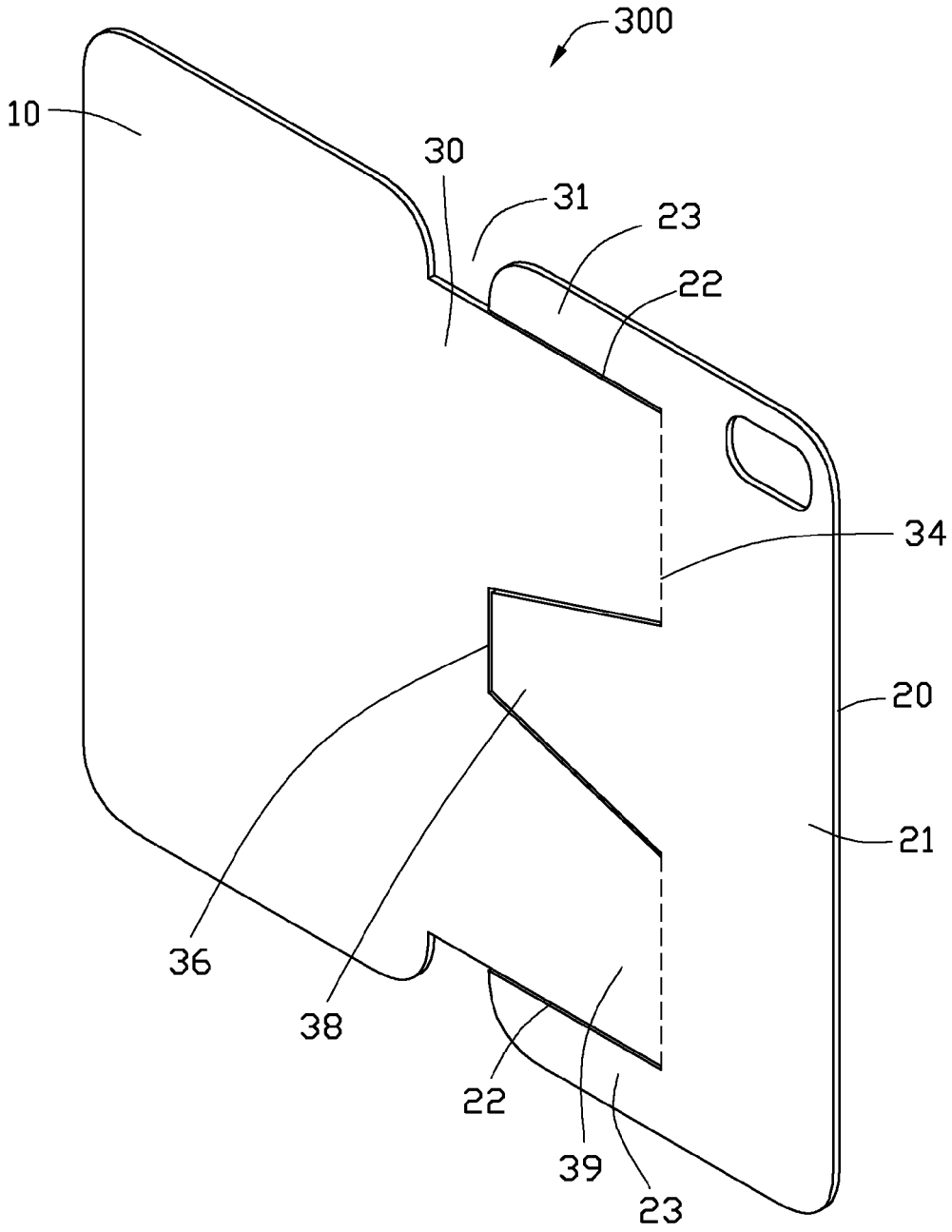
FIG. 8 is a schematic view of a holder in an unfolded state, according to a second exemplary embodiment.

Understandably, the second slit 26 of the holder 100 in the first exemplary embodiment may have other shapes. Referring to FIG. 8, the second slit 36 of the holder 300 in the second exemplary embodiment has two slope edges, and a trapezoid second support portion 38 is formed between the two third support portions 39. A folding line 34 is formed between each third support portion 39 and the main portion 21.

Figure 9:
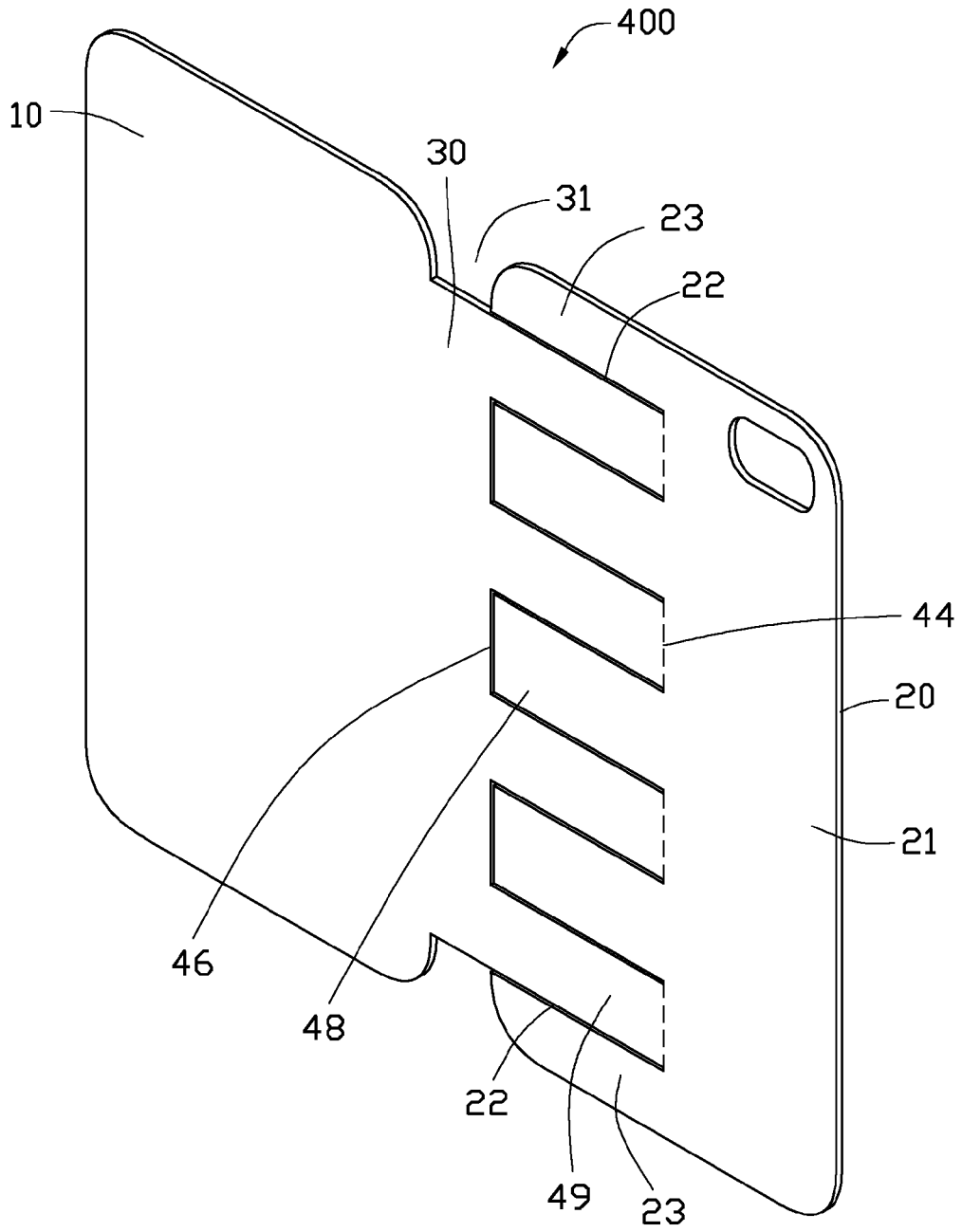
FIG. 9 is a schematic view of a holder in an unfolded state, according to a third exemplary embodiment.
Figure 10:
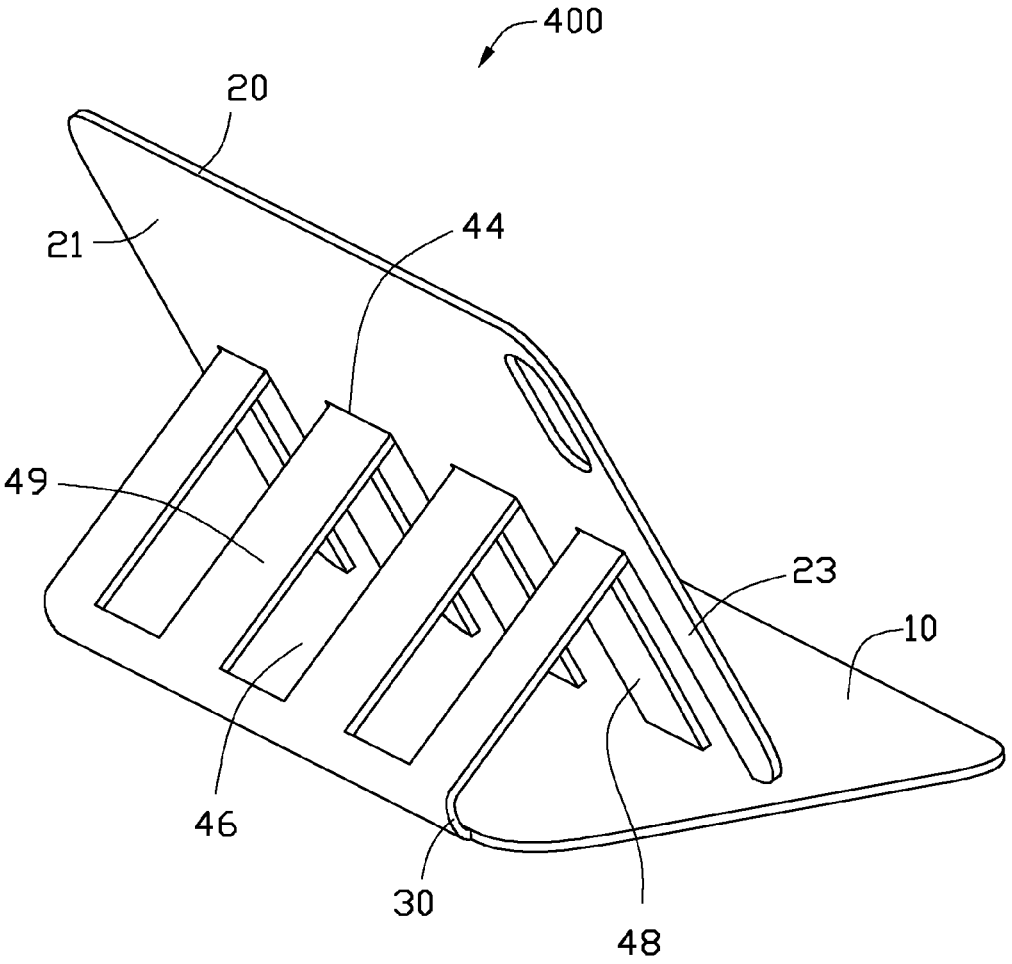
FIG. 10 is a schematic view of the holder shown in FIG. 9 in a folded state.

Understandably, the second slit 26 of the holder 100 in the first exemplary embodiment may have more than one. Referring to FIGS. 9 and 10, the second slit 46 of the holder 400 in the third exemplary embodiment have three, and three second support portions 48 and four third support portion 49 are formed among the second slits 46. A folding line 44 is formed between each third support portion 49 and the main portion 21. When the third support portions 49 are folded along the folding lines 44, the second support portions 48 move out of the second slit 46, and the third support portions 49 form an oblique angle with the main portion 21.

Figure 3:
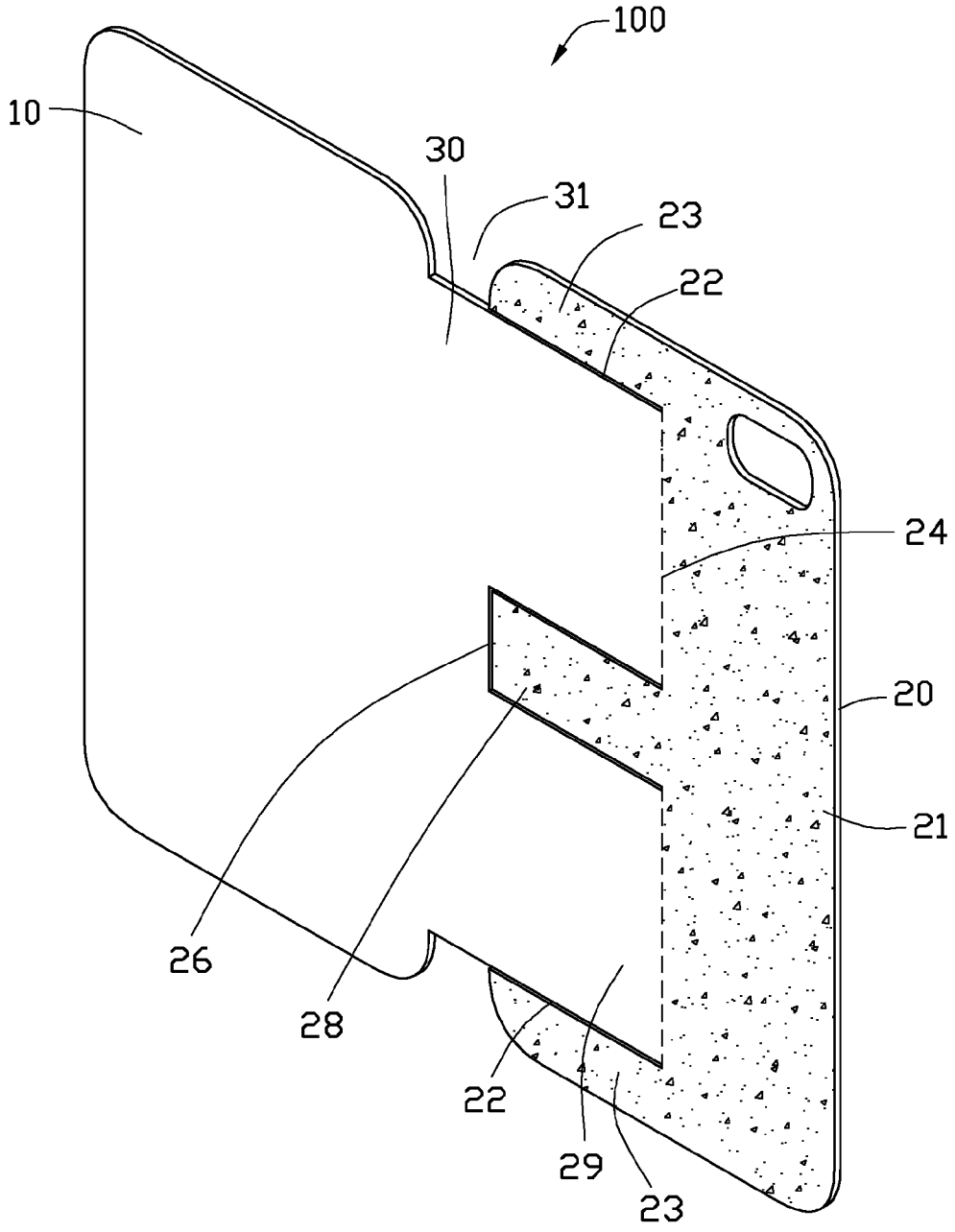
FIG. 3 is a schematic view of the holder shown in FIG. 1, coated by an adhesive.

To connect the second section 20 to the portable electronic device 200, one way is that portions of the second section 20 is mounted on a protective case for receiving the portable electronic device 200. In another way, portions of the second section 20 are directly mounted on the portable electronic device 200. Referring to FIG. 3, the main portion 21, the first support portions 23, and the second portion 28 are coated by an adhesive and are mounted to the rear surface of the portable electronic device 200. In use, referring to FIGS. 4 and 5, the holder 100 is folded along the bending section 30, such that the first section 10 covers the front surface of the portable electronic device 200, to protect the portable electronic device 200.

To support the received portable electronic device 200 at an oblique angle, the un-mounted portions of the second section 20 are folded to hold the portable electronic device 200 in a supported state. In this exemplary embodiment, since the main portion 21, the first support portions 23, and the second portion 28 are mounted to the rear surface of the portable electronic device 200, only the third support portions 23 are folded along the folding lines 24, so that the portable electronic device 200 is supported at an oblique angle. The third support portions 29 are folded along the folding line 24, such that the third support portions 29 are angled with the main portion 21, the first support portions 23, and the second support portion 28, and the first section 10 rests on a platform (not shown). In this angled orientation, the portable electronic device 200 can be viewed comfortably.

It is to be understood that even though numerous characteristics and advantages of the present exemplary embodiments have been set forth in the foregoing description, together with details of structures and functions of various embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A foldable holder for holding and supporting a portable electronic device, comprising:

a first section;

a bending section; and a second section connected to the first section by the bending section, the second section including a main portion, two first support portions, at least one second support portion and at least two third support portions, the at least one second support portion is positioned between the at least two third support portions;

wherein, when folded, the third support portions are folded relative to the main portion, the first support portions and the at least one second support portion support the portable electronic device at an angle relative to the first section.

2. The foldable holder as claimed in claim 1, wherein a length of the bending section is shorter than a length of the first section and the second section, thereby defining a notch between the first section and the second section.

3. The foldable holder as claimed in claim 1, wherein the first section covers a front surface of the portable electronic device with a display, the second section covers a rear surface of the portable electronic device.

4. The foldable holder as claimed in claim 1, wherein the first support portions, the two first support portions, the at least one second support portion, and the at least two third support portions are connected to one side of the main portion.

5. The foldable holder as claimed in claim 4, wherein the second section defines two first slits, the two first slits are positioned at opposite sides of the second section, each first slit is aligned with one edge of the bending section and separates the first support portion from a corresponding third support portion.

6. The foldable holder as claimed in claim 5, wherein there are one second support portion and two third support portions, the second section defines a second slit, the second slit is substantially U-shaped, and defined at a middle area of the second section to separate the second support portion from the third support portions.

7. The foldable holder as claimed in claim 5, wherein there are three second support portions and four third support portions, the second section defines three second slits, each second slit is substantially U-shaped, and separates the three second support portions from the four third support portions.

8. The foldable holder as claimed in claim 7, wherein a folding line is formed between each third support portion and the main portion for allowing the third support portions are folded along the folding line.

9. A foldable holder for holding and supporting a portable electronic device, comprising:

a singular sheet including a bending section and configured for permitting the singular sheet to be folded along the bending section and dividing the singular sheet into a first section and a second section, the first section configured for covering a first surface of the portable electronic device, the second section configured for covering a second surface of the portable electronic device; the second section including folded portions and mounted portions configured for being mounted on the second surface; the second section defining at least one slit positioned between the folded portions and the mounted portions, wherein the mounted portions comprise a main portion, two first support portions, a second support portion, and the folded portions comprise two third support portions, the second support portion are positioned between the two third support portions;

wherein, when the holder is unfolded, the folded portions and the mounted portion are coplanar with each other;

when the holder is folded, the folded portions move out of the at least one slit to be folded relative to the mounted portions to support the portable electronic device in an oblique angle of view for the received portable electronic device.

10. A foldable holder for holding and supporting a portable electronic device, comprising:

a singular sheet including a bending section and configured for permitting the singular sheet to be folded along the bending section and dividing the singular sheet into a first section and a second section, the first section configured for covering a first surface of the portable electronic device, the second section configured for covering a second surface of the portable electronic device; the second section including folded portions and mounted portions configured for being mounted on the second surface; the second section defining at least one slit positioned between the folded portions and the mounted portions, wherein the mounted portions comprise a main portion, two first support portions, three second support portions, the folded portions comprise four third support portions, the second support portions are positioned among the four third support portions;

wherein, when the holder is unfolded, the folded portions and the mounted portion are coplanar with each other;

when the holder is folded, the folded portions move out of the at least one slit to be folded relative to the mounted portions to support the portable electronic device in an oblique angle of view for the received portable electronic device.

* * * * *